United States Patent [19]

Bohnert

[11] Patent Number: 4,929,360

[45] Date of Patent: May 29, 1990

[54] USE OF LAMINATES CONTAINING SUPERABSORBENT POLYMERS FOR ASBESTOS ABATEMENT

[75] Inventor: Thomas J. Bohnert, Midland, Mich.

[73] Assignee: The Dow Chemical Company, Midland, Mich.

[21] Appl. No.: 381,896

[22] Filed: Jul. 19, 1989

[51] Int. Cl.[5] ..... B08B 1/00

[52] U.S. Cl. ..... 210/679; 210/751; 210/660; 134/25.1; 134/25.4; 134/42

[58] Field of Search ..... 210/679, 751, 923, 660; 134/25.1, 25.4, 39, 40, 42

[56] References Cited

U.S. PATENT DOCUMENTS

| | | | |
|---|---|---|---|
| 3,935,099 | 1/1976 | Weaver et al. | 252/312 |
| 4,383,868 | 5/1983 | Braley | 210/660 |
| 4,699,666 | 10/1987 | Tidquist et al. | 134/42 |
| 4,707,266 | 11/1987 | Degen et al. | 210/651 |
| 4,774,974 | 10/1988 | Teter | 134/25.4 |
| 4,803,771 | 2/1989 | Lyons | 134/25.4 |
| 4,817,644 | 4/1989 | Holmes | 134/25.4 |
| 4,821,397 | 4/1989 | Lyons | 134/25.1 |

*Primary Examiner*—Peter Hruskoci
*Assistant Examiner*—Cynthia L. Nessler

[57] ABSTRACT

Asbestos is often removed from buildings by treating the asbestos with water to prevent the asbestos fibers from becoming airborne. The water contaminated with asbestos fibers is then removed. Often the leaks by the contaminated water must then also be contained and eliminated. Aqueous-fluid absorbing polymer, in a vehicle to contain the polymer, absorbs and immobilizes the contaminated water for more efficient disposal of the asbestos.

1 Claim, No Drawings

USE OF LAMINATES CONTAINING SUPERABSORBENT POLYMERS FOR ASBESTOS ABATEMENT

BACKGROUND OF THE INVENTION

Asbestos was installed as an insulating material for buildings and pipes and also as fire-resistant material in buildings. Presently, there is a strong need to remove the asbestos from such buildings because asbestos is thought to cause asbestosis, lung cancer and mesothelioma.

The following is the present method by which asbestos is removed:

The area which has been coated with asbestos, a ceiling, wall or piping for example, is restricted to one particular area by using sheets of plastic, i.e., polyethylene film to seal off a contaminated working area, the seams of the film are held together with materials such as duct tape. The workers are protected with personal protective equipment and a negative pressure is maintained in the contaminated working area. The asbestos is wetted with water to minimize the asbestos fibers from becoming airborne. The asbestos is then removed manually or with pressure sprayers and disposed in polyethylene bags. The area is cleaned, usually with water, to remove traces of asbestos. Unfortunately, often the asbestos contaminated water seeps through the seams of the film or the film may be split during the removal process and the wetted asbestos or asbestos contaminated water can seep through the split in the film and contaminate other areas with the asbestos. Any water which contains asbestos is considered contaminated water and ideally any contaminated water and airborne asbestos should be confined to the contaminated working area.

Accordingly, the present invention is a method of using aqueous-fluid absorbing polymers or superabsorbent polymers in various materials to immobilize the contaminated water. If the contaminated water is held in a material containing superabsorbent polymer or in superabsorbent polymer, the mobility of the contaminated water is thereby reduced and is more readily disposable thereby the threat of contaminating other areas is greatly and desirably reduced.

SUMMARY OF THE INVENTION

The present invention relates to a method of using superabsorbent polymers in vehicles for aqueous absorption which, when exposed to water-containing asbestos fibers, immobilizes the water-containing asbestos fibers.

DETAILED DESCRIPTION OF THE INVENTION

Various aqueous-fluid absorbing polymers are available on the market. These polymers are typically polymerized acrylic acid salts. Typically, such aqueous-fluid absorbing polymers are used in aqueous-fluid absorbing devices such as diapers and incontinent devices.

Polymers are also available in other vehicles for aqueous-fluid absorption. The use of the term "vehicle for holding aqueous-fluid absorbing polymer", as defined herein, includes any material which incorporates aqueous-fluid absorbing polymers and can be used to absorb aqueous solutions. Examples of "vehicles for holding aqueous-fluid absorbing polymer" would include paper, plastic film coated paper, non-woven plastic, cloth, or plastic film or any combination of these to form a laminate, towel or sheet. Laminates can be prepared using aqueous-fluid absorbing polymers by various manufacturing techniques. Some laminate structures are available from such manufacturers as Grain Processing Corporation, Gelok International, and Freudenberg AG.

The methods for using the superabsorbent polymers include the following:

When the area containing asbestos is contained using a primary film, a secondary film or laminate which contains the superabsorbent polymer could be used to catch any asbestos-containing water that leaks through the primary film. Likewise, if a spill occurs which contains asbestos-containing water, a towel which incorporates the superabsorbent polymer could be used to immobilize and wipe-up the spill. Likewise, a film or laminate-containing superabsorbent can be used as the primary film to hold the water-containing asbestos and prevent leakage to a secondary polyethylene film layer.

Various methods of removing asbestos are presently being developed. For example, at the present time water is used merely to wet the asbestos and then the wet asbestos is manually removed and disposed into polyethylene bags, the bags are then removed from the asbestos-containing area. However, methods such as high pressure water sprayers are now being used to remove the asbestos, thereby using a greater amount of water. If a greater amount of water is used, a greater amount of contaminated water is created which, therefore, creates even a greater need for a aqueous-fluid absorbing material to prevent the mobility of the water-containing asbestos. The primary objective is to reduce and hopefully eliminate the movement of the asbestos and the water as greatly as possible from the containment area. Water does this by removing the asbestos from the air and minimizing the asbestos from becoming airborne. The present invention then further immobilizes the contaminated water.

Although it is possible to take the superabsorbent powder and sprinkle it on the primary film which contains the asbestos-containing area, such a method might release superabsorbent dust into the air which may be an undesirable method for the use of superabsorbent polymers. It could also cause the plastic film to become very slippery, and generate pinholes in the plastic film from walking on the polymer powder. Therefore, the preferred method of the present invention is to incorporate the superabsorbent polymer into a vehicle which can be used to hold the polymer stationary while the polymer absorbs the water-containing asbestos.

What is claimed is:

1. A method which comprises immobilizing water which contains asbestos fibers by incorporating aqueous-fluid absorbing polymer in a vehicle for holding aqueous-fluid absorbing polymer, exposing the vehicle to water containing asbestos fibers, wherein the aqueous-fluid absorbing polymer absorbs the water containing asbestos fibers.

* * * * *